US006398096B1

(12) United States Patent
Lang

(10) Patent No.: US 6,398,096 B1
(45) Date of Patent: Jun. 4, 2002

(54) HYDRAULIC DRIVE MECHANISM FOR A JOINING TOOL

(75) Inventor: Hans Jörg Lang, Werther (DE)

(73) Assignee: Bollhoff GmbH, Bielefeld (DE)

( * ) Notice: Subject to any disclaimer, the term of this patent is extended or adjusted under 35 U.S.C. 154(b) by 0 days.

(21) Appl. No.: 09/579,802

(22) Filed: May 26, 2000

(30) Foreign Application Priority Data

May 27, 1999 (DE) ..... 199 24 310

(51) Int. Cl.[7] ..... B21J 15/02

(52) U.S. Cl. ..... 227/51; 227/152; 227/153; 29/432.2; 29/243.53; 29/716; 72/312

(58) Field of Search ..... 173/206; 227/51, 227/152, 153; 29/243.53, 407.05, 525.06, 716, 432.2; 72/312, 328, 390

(56) References Cited

U.S. PATENT DOCUMENTS 4,096,727 A * 6/1978 Gargaillo ..... 72/312
4,516,448 A * 5/1985 Hill et al. ..... 83/137
5,687,567 A * 11/1997 Hansson et al. ..... 60/413
5,752,305 A * 5/1998 Colterhill et al. ..... 29/243.53
6,276,050 B1 * 8/2001 Maurer et al. ..... 29/716

FOREIGN PATENT DOCUMENTS

EP 675774 3/1998
WO 9926743 6/1999

* cited by examiner

*Primary Examiner*—Scott A. Smith
(74) *Attorney, Agent, or Firm*—Seyfarth Shaw

(57) ABSTRACT

A hydraulic drive mechanism to actuate a tool for joining at least two work-pieces of ductile material such as by self-piercing riveting or clinching. The drive mechanism comprises a punch drive for actuating a punch and a clamp drive for actuating a clamp which clamps the workpieces against an up-setting die during the joining operation. Both drives comprise piston cylinder assemblies. The piston cylinder assembly of the clamp drive is carried by the piston rod of the punch drive. The pressure chamber of the clamp drive communicates with one of the work chambers of the punch drive such that pressure within the work chamber of the punch drive is transmitted to the pressure chamber of the clamp drive in order to generate the clamping force. As a result thereof only a pair of fluid connections are required for operating both drives.

7 Claims, 2 Drawing Sheets

HYDRAULIC DRIVE MECHANISM FOR A JOINING TOOL

FIELD OF THE INVENTION

This invention relates to a hydraulic drive mechanism to actuate a tool for joining at least a pair of workpieces of ductile material, in particular for self-piercing riveting or clinching.

BACKGROUND OF THE INVENTION

Drive mechanisms such as disclosed in EP 0 675 774 B1 generally comprise a punch drive for actuating a punch to perform the joining operation and a clamp drive for actuating a clamp or nose clamping the workpieces against an up-setting die during the joining operation. Both drives comprise piston cylinder assemblies. The cylinders of both drives are fixedly connected to each other, and the piston of the clamp drive is concentrically arranged between the piston rod of the punch drive and the cylinder of the clamp drive such that the piston of the clamp drive is telescopically displaceable by being pressurized via a pressure chamber with a fluid connection in order to generate the clamping force. While a spring is used to reset the piston of the clamp drive, the drive mechanism still requires three fluid connections (two for the punch drive and one for the clamp drive) resulting in a somewhat complex structure of the drive mechanism and its hydraulic supply system.

Furthermore it has become known to use a spring supported against the piston of the punch drive to generate the clamping force. While this simplifies the structure of the drive mechanism and in particular of its hydraulic supply system, this drive mechanism does not allow to generate a uniform clamping force because the spring force varies in response to movements of the punch.

SUMMARY OF THE INVENTION

It is a primary object of the present invention to provide a hydraulic drive mechanism to actuate a tool for joining at least two workpieces of ductile material, which drive mechanism is of simple structure and yet allows to generate a uniform hydraulic clamping force for clamping the workpieces against an up-setting die.

In the hydraulic drive mechanism of the present invention the clamp drive is carried by the piston rod of the punch drive and the pressure chamber of the clamp drive communicates with a second work chamber of the punch drive via a flow passage such that pressure from the second work chamber of the punch drive is transmitted to the pressure chamber of the clamp drive in order to generate the clamping force.

Preferably the fluid connection of the second work chamber of the punch drive is arranged to communicate with a low pressure region via a pressure limiting valve in order to limit, via said flow passage, the pressure within the pressure chamber of the clamp drive to thereby limit the clamping force.

The clamping force is generated by the pressure in one of the work chambers of the punch drive. As a result thereof only two fluid connections are required to operate the drive mechanism. A further advantage of the invention is that it is only the punch drive which has to be lengthened in order to increase the feed stroke of the clamp and the punch, because a respective lengthening of the feed stroke of the clamp drive carried by the punch drive will automatically result therefrom. This will result altogether in easier handling of and improved access to the drive mechanism. Furthermore, the drive mechanism of the present invention is of low manufacturing and assembly costs resulting from the simplified structure, the reduced number of stroke dependent parts and the simplified hydraulic supply system.

BRIEF DESCRIPTION OF THE DRAWINGS

A preferred embodiment of the invention will be described in more detail with reference to the accompanying drawings wherein.

DESCRIPTION OF THE PREFERRED EMBODIMENT

Figure 1:
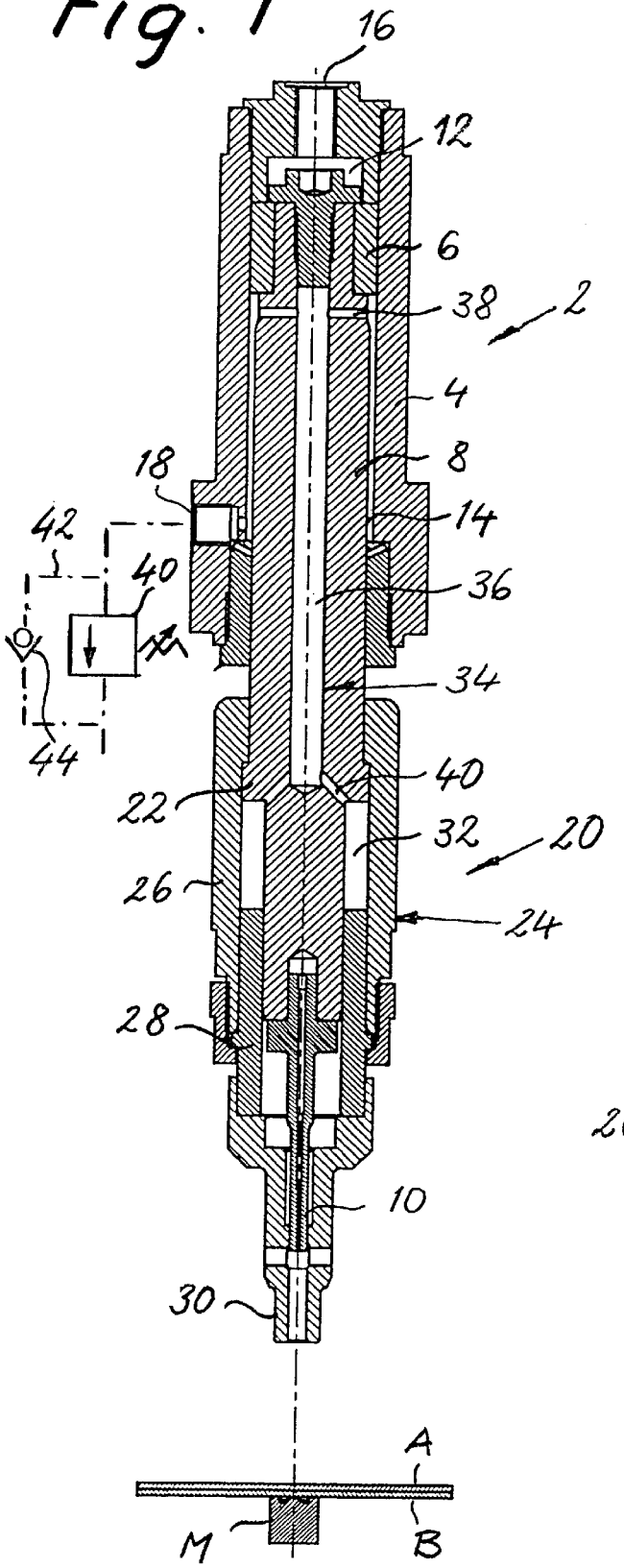
FIGS. 1 to 4 are longitudinal sections of a hydraulic drive mechanism in different operative positions.

The drive mechanism shown in the drawings is used to join a pair of plate-shaped workpieces A, B supported against an up-setting die M by self-piercing riveting. It is to be understood that the drive mechanism may be used also for other joining operations such as clinching or, more generally, processing of workpieces by means of a punch as may be used for example in die-punching operations.

The drive mechanism includes a punch drive 2 comprising a piston cylinder assembly with a cylinder 4 which may be fixedly mounted to a C-frame (not shown). The cylinder 4 slidingly receives a piston 6 having a piston rod 8. The piston 6 divides the interior of the cylinder 4 into a first work chamber 12 and a second work chamber 14 each of which may be connected to a hydraulic pressure source (not shown) via respective fluid connections 16 and 18.

The piston rod 8 has its lower end fixedly connected to a punch 10 which is used to perform the riveting operation in the embodiment shown in the drawings.

The piston rod 8 of the punch drive 2 carries freely a clamp drive 20 which also comprises a piston cylinder assembly. More specifically, the clamp drive 20 has a piston 22 which is integral with the piston rod 8, i.e. is fixedly connected to the piston rod 8. Furthermore the clamp drive 20 has a cylinder 24 which is slidingly mounted on the piston rod 8 of the punch drive 2 so as to be telescopically displaceable thereon. As a result thereof the piston 22 and the cylinder 24 are slidingly displaceable with respect to each other.

The cylinder 24 has at its lower end a clamp means 30 which is comprised of a nose portion slidingly receiving the punch 10 and used to clamp the workpieces A, B against the upsetting die M.

The cylinder 24 comprises an outer bushing 26 slidingly guided on an upper portion of the piston rod 8, and an inner bushing 28 slidingly guided on a lower portion of the piston rod 8, such that a pressure chamber 32 is formed between the piston 22, the inner wall of the outer bushing 24 and an end face of the inner bushing 28.

The pressure chamber 32 of the clamp drive 20 communicates with the work chamber 14 of the punch drive 2 via a flow passage 34. The flow passage 34—which is always open—comprises a longitudinal bore 36 centrally disposed in the piston rod 8 and communicating with the work chamber 8 via branched-off bores 38 and with the pressure chamber 32 via branched-off bores 40.

As schematically shown in FIG. 1, the fluid connection 18 can be communicated with a low pressure region (e.g. tank, not shown) via a pressure limiting valve 40 in order to limit the pressure in the work chamber 8 and in the pressure chamber 32 as will be explained in more detail below. The pressure limiting valve 40 is preferably a controllable pressure limiting valve providing a pressure limit which may be set e.g. manually. As shown also schematically, a check valve 44 is connected in parallel to the pressure limiting valve 40 by a bypass line 42 in order to pressurize the fluid connection 18 as will be explained in more detail below.

Operation of the described drive mechanism will now be described.

FIG. 1 shows the drive mechanism in its initial position when the work chamber 12 is pressureless and the work chamber 8 along with the pressure chamber 32 are filled with hydraulic fluid. When the pressure chamber 12 is being pressurized via the fluid connection 16, the piston 6 of the punch drive 2 along with the clamp drive 20 mounted on the piston rod 8 move downwards. As a result thereof hydraulic fluid is discharged from the work chamber 8 via the fluid connection 18. When the pressure within the work chamber 8 and within the pressure chamber 2 reaches the pressure limit as set by the pressure limiting valve 40, hydraulic fluid is discharged from the work chamber 8 to the low pressure region.

Figure 2:
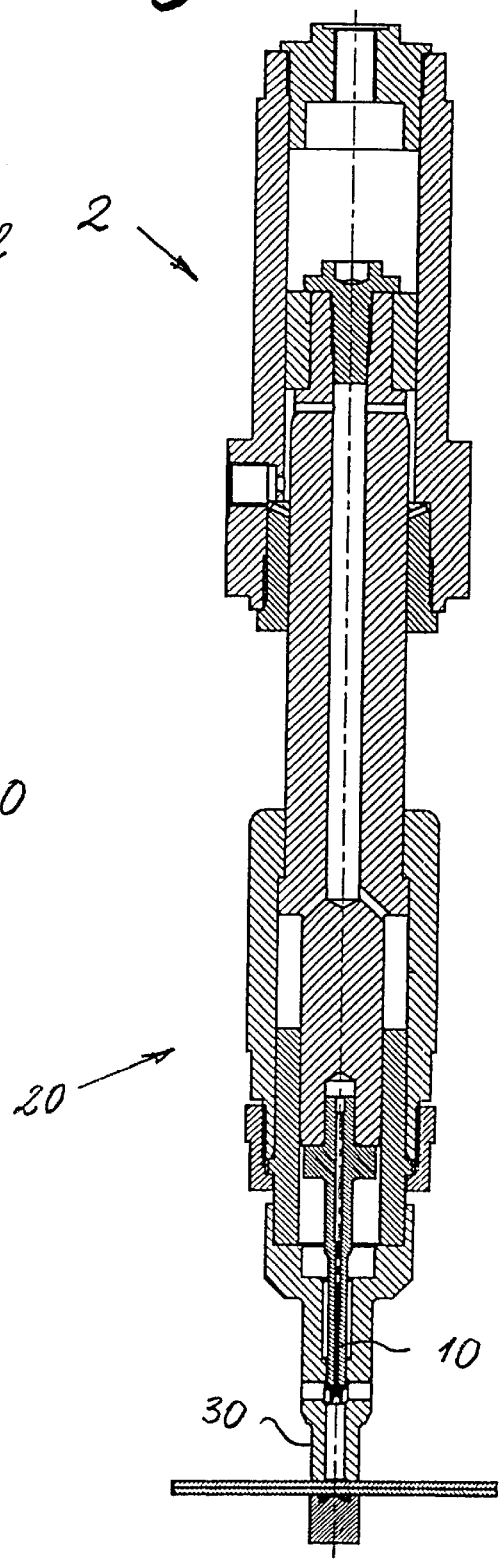

When the clamp means 30 during downward movement of the piston 6 and clamp drive 20 engages the workpieces A, B (as shown in FIG. 2), the clamp means 30 clamps the workpieces A, B against the upsetting die M under a uniform clamping force the amount of which is determined by the pressure transmitted to the pressure chamber 32 via the flow passage 34 and limited by the pressure limiting valve 40.

Figure 3:
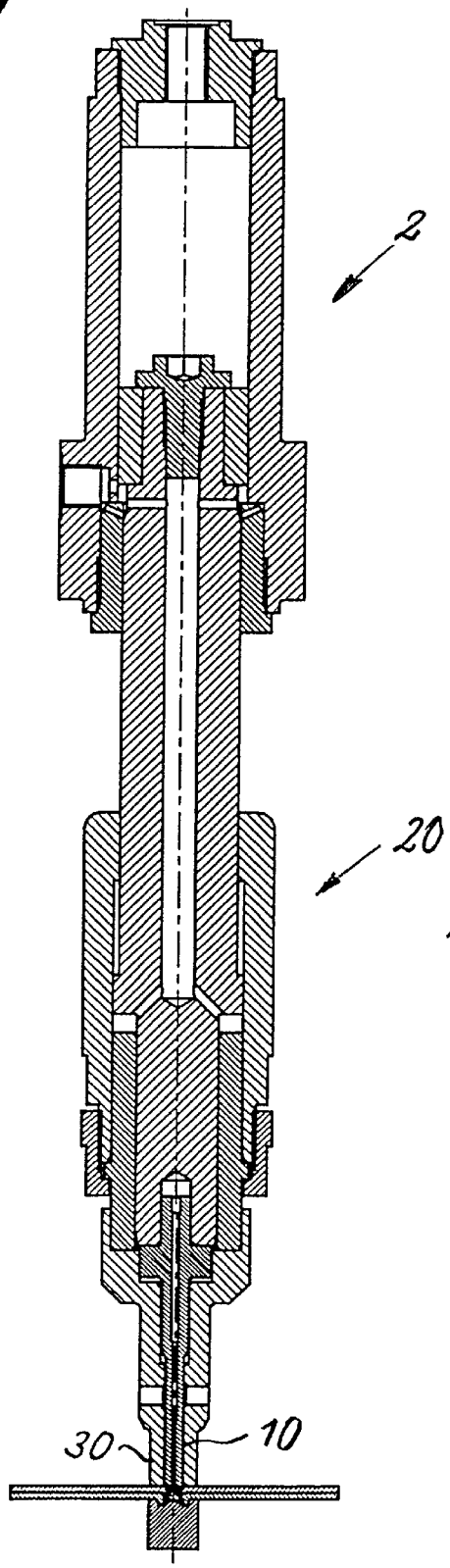

At the same time the piston 6 along with its piston rod 8 and the punch 10 fixed thereto move further downwards in order to perform the joining operation, i.e. to drive a rivet through the workpieces A, B (as shown in FIG. 3). During this further downward movement the piston 22 on the piston rod 8 and the cylinder 24 of the clamp drive 20 supported against the workpieces A, B move relative to each other. As a result thereof pressure fluid is discharged from the pressure chamber 32 via the flow passage 34, work chamber 8 and the fluid connection 18 through the pressure limiting valve 40 to the low pressure region. At this time the pressure limiting 40 ensures that the clamping force exerted by the clamp 30 upon the workpieces A, B is maintained unchanged.

Figure 4:
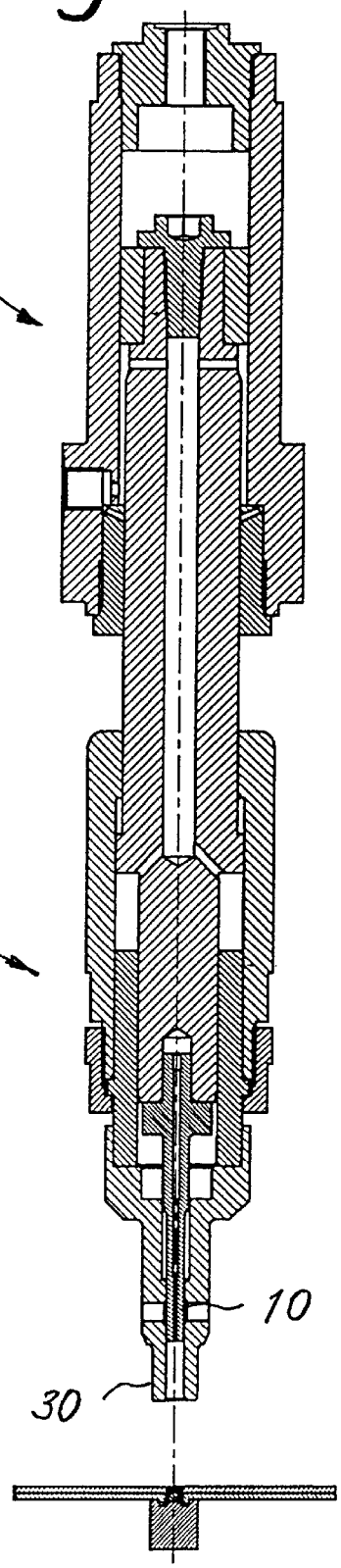

When the joining operation has been terminated, pressure is released from the work chamber 12 via the fluid connection 16, and the work chamber 8 is pressurized via the fluid connection 18 so that the piston 6 including the piston rod 8 and the punch 10 are returned to their inoperative positions (as shown in FIG. 4). The work chamber 8 and the pressure chamber 32 are again filled with hydraulic fluid until the drive mechanism will be again in its initial position shown in FIG. 1.

As shown in the figures, the piston rod has, in the area of the work chamber 14, an outer diameter which is only slightly smaller than the inner diameter of the cylinder 4. The displaceable volume and the cross sectional area of the work chamber 4 are very small as a result thereof This ensures that the reaction force resulting from the pressure in the work chamber and to be overcome by the piston 6 of the punch drive 2 during its feed stroke, is relatively small.

What is claimed is:

1. A hydraulic drive mechanism to actuate a tool for joining at least two workpieces of ductile material, comprising a punch drive for actuating a punch to exert a joining force, said punch drive comprising a piston cylinder assembly including a piston with a piston rod and a cylinder with first and second work chambers, the first work chamber being pressurized via a first fluid connection to move said punch from an inoperative position to an operative position and the second work chamber being pressurized via a second fluid connection to return said punch from said operative position to said inoperative postion, and a clamp drive for actuating a clamp means providing a clamping force for clamping said at least two workpieces during the joining operation against an upsetting die, said clamp drive comprising a piston cylinder assembly including a pressure chamber which is pressurized for generating said clamping force, the piston cylinder assembly of said clamp drive being carried by said piston rod of said punch drive, and said pressure chamber of said clamp drive communicating with said second work chamber of said punch drive via a flow passage such that pressure from said second work chamber of said punch drive is transmitted to said pressure chamber of said clamp drive in order to generate said clamping force.

2. The hydraulic drive mechanism of claim 1 wherein said second fluid connection of said second work chamber of said punch drive is arranged to communicate with a low pressure region via a pressure limiting valve in order to limit, via said flow passage, the pressure within said pressure chamber of said clamp drive to thereby limit the clamping force.

3. The hydraulic drive mechanism of claim 1 wherein said clamp drive has a cylinder mounted on said piston rod of said punch drive so as to be telescopically displaceable thereon.

4. The hydraulic drive mechanism of claim 3 wherein said clamp means is fixedly connected to the cylinder of said clamp drive.

5. The hydraulic drive mechanism of claim 1 wherein said flow passage comprises a longitudinal bore extending through the piston rod of said punch drive and a plurality of transverse bores branched-off from said longitudinal bore and opening into said second work chamber and, respectively, said pressure chamber.

6. The hydraulic drive mechanism of claim 1 wherein the clamp drive has a piston integral with the piston rod of said punch drive.

7. The hydraulic drive mechanism of claim 1 wherein the piston rod of said punch drive has an outer diameter which, in the area of said second work chamber, is only slightly smaller than the inner diameter of the cylinder of said punch drive.

* * * * *